United States Patent [19]

Gustafson

[11] Patent Number: 4,474,376

[45] Date of Patent: Oct. 2, 1984

[54] MANIPULABLE ICOSAHEDRON TOY

[76] Inventor: William O. Gustafson, 2712 E. Robinson Ave., Fresno, Calif. 93726

[21] Appl. No.: 333,340

[22] Filed: Dec. 22, 1981

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 3,690,672 | 9/1972 | Dreyer | 273/155 |

FOREIGN PATENT DOCUMENTS

| | | | |
|---|---|---|---|
| G8104382.1 | 7/1981 | Fed. Rep. of Germany | 273/153 S |
| 2405077 | 5/1979 | France | 273/153 S |
| 55-8193 | 3/1980 | Japan | 273/153 S |

*Primary Examiner*—Anton O. Oechsle

[57] ABSTRACT

A puzzle corresponding to a regular icosahedron in which the twenty faces of the icosahedron are detached yet movable, the puzzle including a spherical core; twelve mushroom-shaped holding pins extending from the core individually at locations corresponding to icosahedral vertex points and having a head spaced from the core; a plurality of turning elements extending between adjacent holding pins and slidably engaged between the heads and the core for pivotal movement in multiple of seventy-two degree rotation about a selected one of such adjacent holding pins; and a plurality of exterior plates fixedly and individually mounted on the turning elements for pivotal movement with the turning elements, the exterior plates having varigated surfaces which can be brought by a succession of movements into a preferred arrangement after having been scrambled by rotation about various axes. The exterior plates of the puzzle corresponding to the faces of the icosahedron.

1 Claim, 10 Drawing Figures

MANIPULABLE ICOSAHEDRON TOY

The present invention relates to an icosahedron puzzle toy having a plurality of varigated parts which are movable relative to one another to form various configurations. Plato gave the world the concept of the so-called five Platonic Solids. They are the tetrahedron, hexahedron, octahedron, dodecahedron and the icosahedron. These five solids have inspired many puzzle toys over the many centuries since Plato'time. The present invention concerns only the icosahedron. It is known that an icosahedron consists of exactly twenty equilateral triangular faces, exactly twelve vertices, and exactly thirty edges.

It is a known object of puzzles to employ a plurality of parts adopted for connection or disconnection or, as in this present case, for relative movement in a predetermined and possibly baffling manner, sequence, or ordered arrangement. Puzzles of this sort are a never-ending source of amusement challenging the user's ingenuity, patience and insight to effect a solution. It is to this type of puzzle that the icosahedron puzzle toy of the present invention relates.

Accordingly it is an object of the present invention to provide a puzzle having varigated equilateral triangular parts movable relative to one another to form various patterns.

Another object is to provide a device to capture the interest of the puzzle enthusiast.

Another object is to provide a toy which is economical to manufacture from simple moldable parts.

These, together with other objects will become more fully apparent upon reference to the drawings and the following description:

Figure 1:
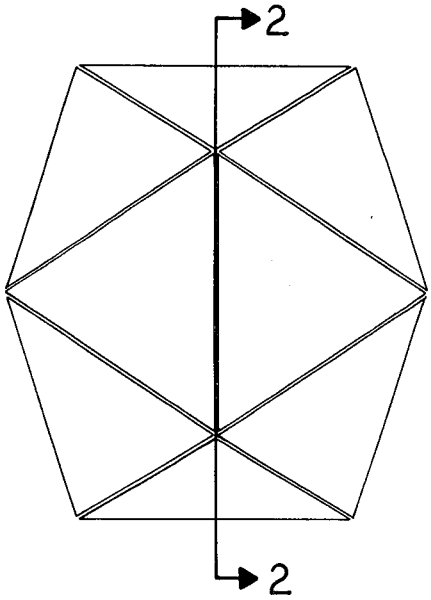
FIG. 1 shows a view of the fully assembled icosahedron shown full scale.
Figure 2:
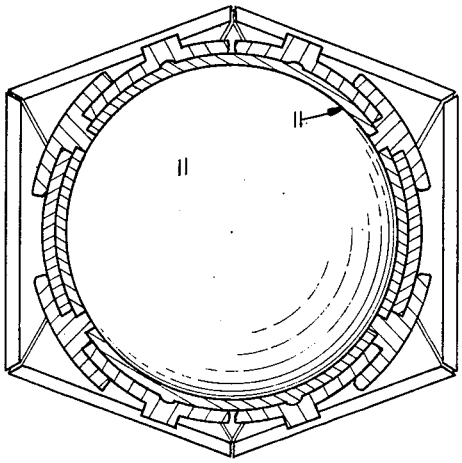
FIG. 2 is a transverse action of FIG. 1 taken on line 2—2 shown full scale.
Figure 3:
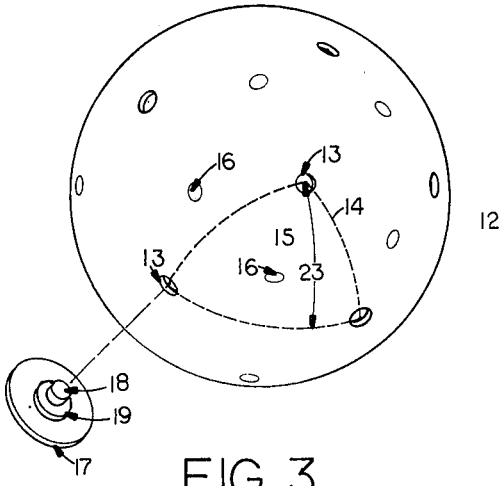
FIG. 3 shows the core with one holding pin exploded away from its hole shown full scale.
Figure 5:
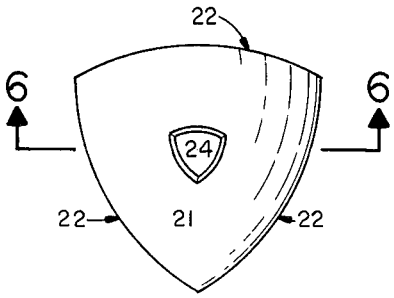
FIG. 5 shows the outside surface of a turning plate to an enlarged scale.
Figure 4:
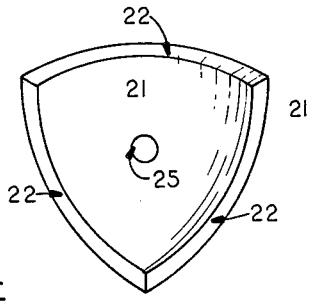
FIG. 4 shows the inside surface of a turning plate to an enlarged scale.
Figure 6:
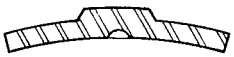
FIG. 6 shows a transverse section of FIG. 5 taken on line 6—6 to an enlarged scale.

Referring more particularly to the accompanying drawings, the toy of the present invention is constructed from four different parts. They are:

(1) An inner core 12 with an outer surface 11 substantially of a smooth spherical nature. This inner core has exactly twelve small holes 13 each small hole placed approximately 63.43 degrees 14 from each of five nearer holes. At the center of each of twenty triangular regions

15 formed by any adjacent grouping of three small holes 13 is a detent 16.

(2) Twelve holding pins 20 each to be placed in a hole 13 of the core 12 and bonded to the core 12. Each holding pin 20 has three features, a shaft 18 to fit the holes in the core, a collar 19 approximately ten degrees in diameter and the principal holding part 17 approximately thirty-six degrees in diameter.

(3) Twenty turning plates 21 of spherical curvature each with edges 22 of circular curvature and length approximately 58.28 degrees 23 in radius. At the center of the outer convex surface of each holding plate is a raised portion 24 and at the center of the innter concave surface of each holding plate is an indent 25.

(4) Twenty flat equilateral triangular plates 26 whose edges are beveled inwardly 27 with a bevel angle of approximately forty degrees 29. In the center of inside surface of each triangle is an indented triangular region 28 which matches the triangular region 24 and is bonded thereto.

Figure 7:
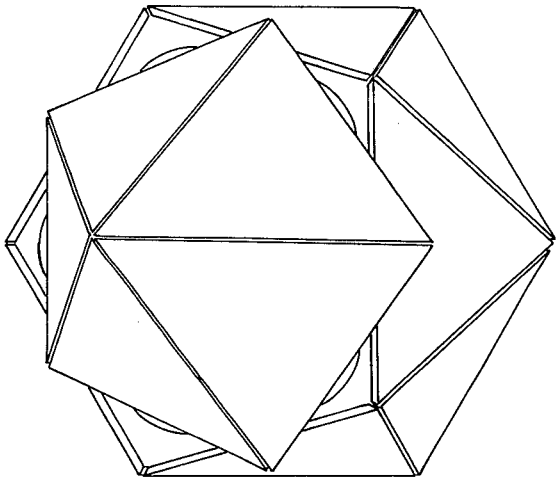
FIG. 7 shows a view of the fully assembled icosahedron with one pentagonal grouping of triangles rotated through about half its necessary rotation to a scale not necessarily the same as FIG. 1.
Figure 9:
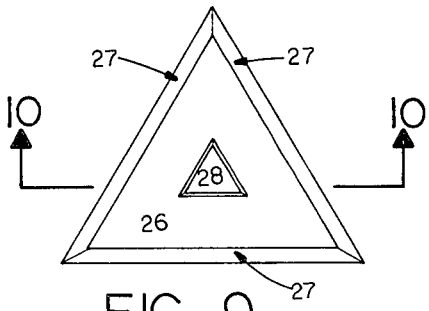
FIG. 9 shows an inside view of one of the outer triangular parts not necessarily to the same scale as FIG. 7.
Figure 10:
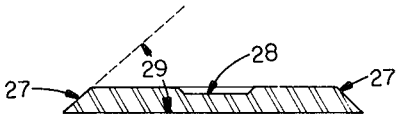
FIG. 10 is a transverse section of FIG. 9 taken on line 10—10 not necessarily to the same scale as FIG. 7.
Figure 8:
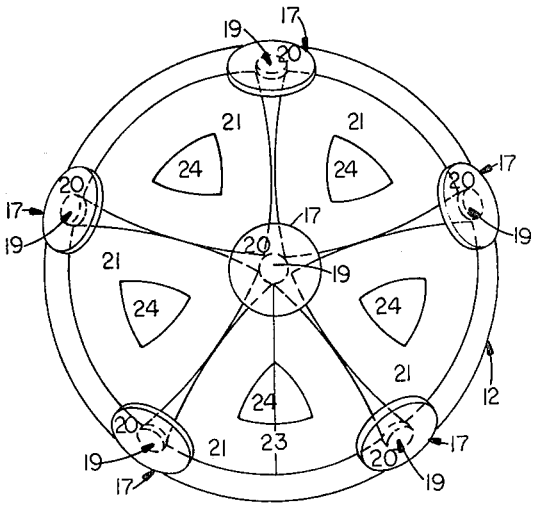
FIG. 8 shows a view of the core showing five turning plates in place not necessarily to the same scale as FIG. 3.

The outer portion 17 of the holding pins 20 project into the slot formed between the core 11 and the turning plates 21 and since the flat triangular plates 26 are attached by bonding the small triangular regions 28 of said flat triangular plates 26 to the small triangular regions 24 of the turning plates 21 with a suitable cement, the finally assembled icosahedron puzzle will not come apart without considerable forcing and thus breaking some of the parts. The detents 16 and the indents 25 serve as an indexing device which insures that any pyramidal grouping of five flat triangular plates will be properly lined-up after a rotation of seventy-two degrees. FIG. 7 shows one such possible grouping which has been rotated through an angle of about half the necessary rotation of seventy-two degrees.

The operation of the finally assembled icosahedron puzzle is accomplished by grasping the puzzle in both hands. Using say the left hand in holding a major portion of the puzzle, the right hand would be placed on a desired selection of a pyramidal grouping of five flat triangles. The left hand should be firmly pressing the plates radially to the core while the right hand exerts a slight torque. Thus, the indents of the turning plates are lifted out of their indexing positions and will "click" back into a new position after a seventy-two degree rotation. Then a new pyramidal grouping of five triangles may be selected and the process repeated. Continuing in this manner a bewildering complexity of different arrangements could be affected which offers the possibility of an astronomical number of permutations.

The assembly of the icoschedron puzzle can be accomplished by applying a suitable cement to all surfaces of the shaft 18 and the concave surface of 19 of the holding pin 20 and placing said holding pin 20 in its hole 13 in the core 12. Eleven such holding pins 20 could thus be cemented into place. Then twenty turning plates 21 could be slipped into place, after which the twelveth holding pin 20 could be cemented into place. Then each of twenty flat triangular plates could be cemented into place by matching the triangular region 28 of each triangular plates with its corresponding triangular region 24 of each turning plate 21 using a suitable cement applied prior to the bonding.

Therefore your petitioner pleads that Letters Patent may be granted based on the following claims.

I claim:

1. A manipulable icosahedron toy comprising:

(a) a spherical core with twelve small holes each spaced 63.43 degrees from each of five other holes and in the centers of each of the twenty triangular regions formed by three adjacent holes is a small detent;

(b) twelve holding pins each comprising three successive concentric circular sections of spherical shells, the outer most section being approximately thirty-six degrees in diameter, the middle section being approximately ten degrees in diameter and the innermost section whose diameter matches the holes in the core for bonding thereto:

(c) twenty turning plates of spherical curvature whose concave surface substantially conforms to the core, the sides of the turning plates are arcs of small circles 58.28 degrees in radius, at the center of the concave surface of each turning plate is a small indent matching the detent in the core, at the center of outside surface of each turning plates is a small raised triangular region:

(d) twenty flat triangular plates beveled inwardly with a small triangular region indented at its inside center and each bonded to one of the small raised triangular regions of a turning plate.

* * * * *